United States Patent [19]

Jones

[11] Patent Number: 4,525,117

[45] Date of Patent: Jun. 25, 1985

[54] WIRE BINDING MACHINES

[75] Inventor: Leonard W. N. Jones, Camberley, England

[73] Assignee: James Burn Bindings Limited, Surrey, England

[21] Appl. No.: 495,439

[22] Filed: May 17, 1983

[30] Foreign Application Priority Data

May 21, 1982 [GB] United Kingdom ..... 8214896

[51] Int. Cl.[3] ..... B42B 4/00; B42B 5/00; B21F 45/22; B21F 45/00

[52] U.S. Cl. ..... 412/39; 412/7; 140/92.4; 140/71 R

[58] Field of Search ..... 412/39, 7; 140/92.4, 140/92.6, 92.7, 71 R

[56] References Cited

U.S. PATENT DOCUMENTS

| | | | |
|---|---|---|---|
| 3,334,918 | 8/1967 | Pigna et al. | 412/7 |
| 3,555,587 | 11/1968 | Seaborn | 412/39 |
| 3,667,076 | 6/1972 | Aglaghanian | 412/39 |
| 3,854,158 | 12/1974 | Pigna et al. | 412/39 |
| 3,883,916 | 5/1975 | Adams et al. | 412/39 |
| 3,889,303 | 6/1975 | Adams et al. | 412/39 |
| 4,398,856 | 8/1983 | Archer et al. | 412/39 |

*Primary Examiner*—Paul A. Bell
*Assistant Examiner*—Paul M/ Heyrana, Sr.
*Attorney, Agent, or Firm*—Wood, Herron & Evans

[57] ABSTRACT

A wire binding machine for accepting and closing together wire binding elements of the Wire-O type to bind a stack of sheets, the machine being controlled to present two or more elements to the closing or binding station with the option of a gap between the elements so that if required a calendar hanger can be fed between the elements prior to the closing operation, the elements being spaceable by means of a first or feed conveyor feeding up to a parallel section of a second or spacing conveyor and pushing the elements from the first to the second conveyor with an interval representing the desired gap.

8 Claims, 18 Drawing Figures

To control valve
To 2nd cylinder

WIRE BINDING MACHINES

The present invention relates to wire binding machines for closing wire binding elements to bind bundles of sheets. It is particularly applicable to those machines which use binding which are each formed from a length of metal wire bent to form a series of curved hairpin-shaped prongs on which sheets are impaled and which are brought to ring shape by pressing their closed ends or "points" into the vicinity of their open ends or "roots". Such binding elements will be referred to herein as "Wire-O" (Registered Trade Mark) binding elements.

Binding machines of the kind described above will be referred to herein as "machines of the kind set forth".

Figure 5:
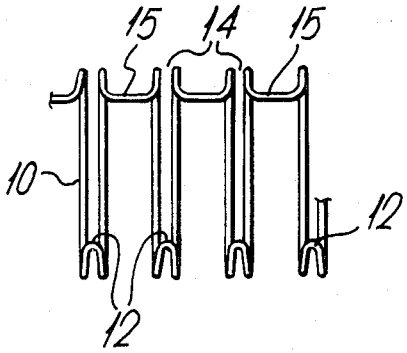
Figure 6:
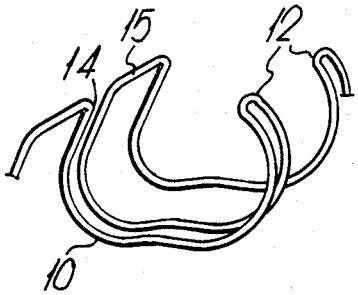

"Wire-O" binding elements as shown in FIGS. 5 and 6 of the present application are supplied to machines of the kind set forth from spools in the form of a long continuous "strip" in a so called "open" condition, the end view being as shown in FIG. 6. The "strip" is then cut into lengths referred to as "elements" and the "points" shown at 12 in FIG. 5 are formed by a closing device of the machine into the "closed" position so that the end view is approximately circular of a predetermined "diameter" with the "points" formed into the "roots" shown at 14. Wire portions between the roots as shown at 15 will be referred to as "blunts". The distance between the "points" will be referred to as the "pitch" of the strips. The bundles of sheets to be bound whether in substantially book pad or like form or variations thereof will be generally referred to as "bundles" or stacks.

In known machines it is sometimes required to interrupt the binding of a bundle, that is to bind a bundle with several elements with a gap in between. Such an interrupted binding can be used to insert calendar hangers between elements. Interrupted binding is known as "skip binding". Hitherto skip binding has been conducted by supplying to the binding machine a strip already cut into elements with gaps between each element. This requires a special wire supply which can only be used for a particular binding operation.

A machine of the kind set forth according to the present invention comprises input feed means arranged to accept binding strip, a first feed conveyor arranged to feed the strip from the input feed means, a cutting means enabled to cut the strip into binding elements of predetermined length, a second feed conveyor running parallel to at least part of the first conveyor, a closing means at a closing station arranged to be fed with the elements, means for translating the elements from the first conveyor to the second conveyor as they are cut and for further translating all the elements to the closing means.

The machine of the invention is enabled to use any uncut wire supply and is adapted by suitable control arrangements to bind bundles with either uninterrupted wire elements or several wire elements with a gap in between into which can be fed a calendar hanger.

Figure 1:
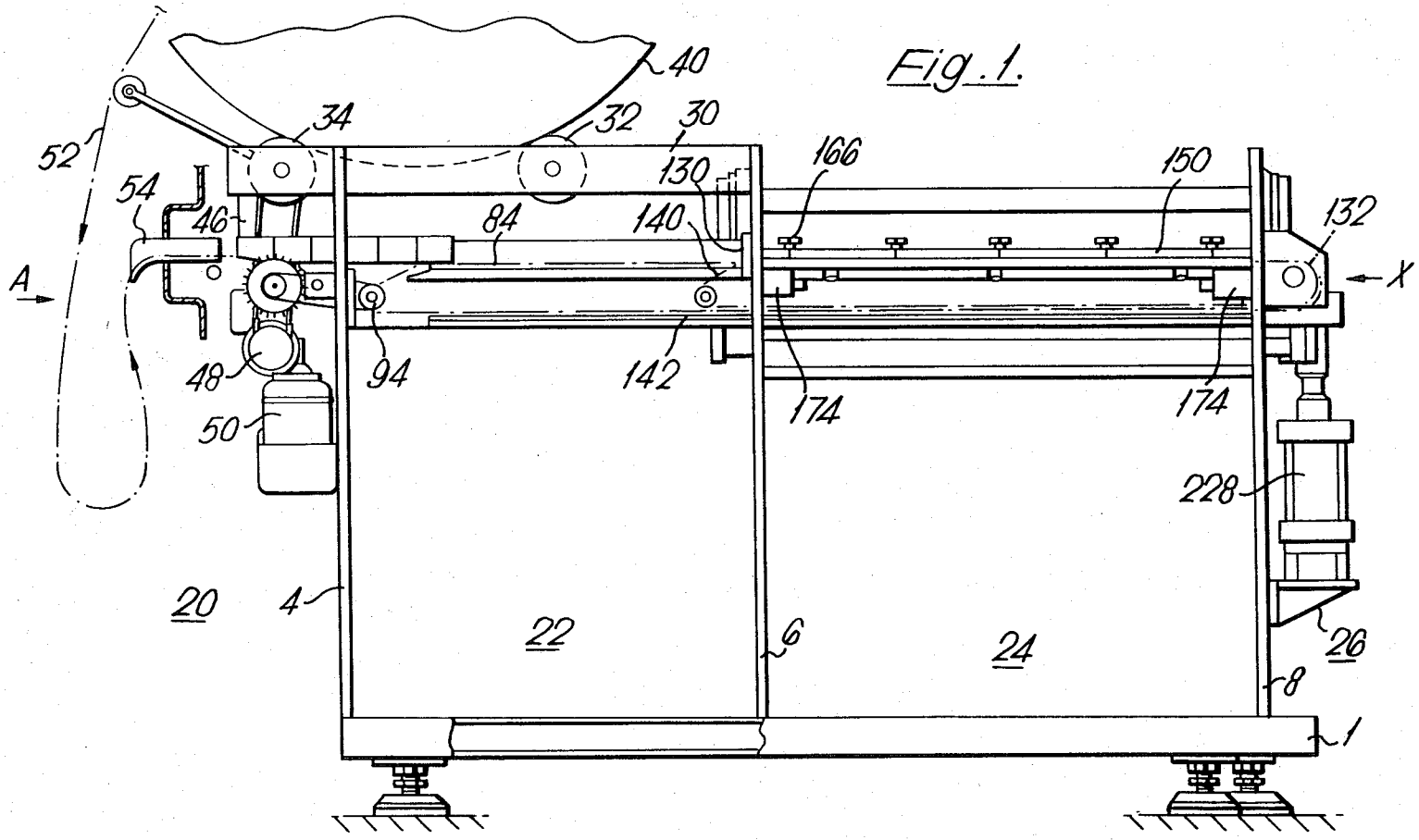
Figure 2:
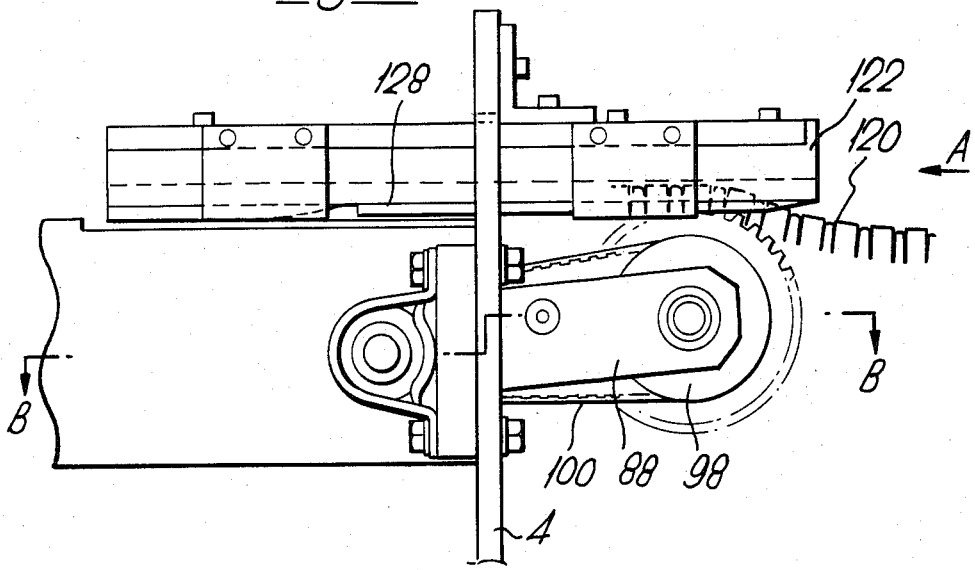
Figure 3:
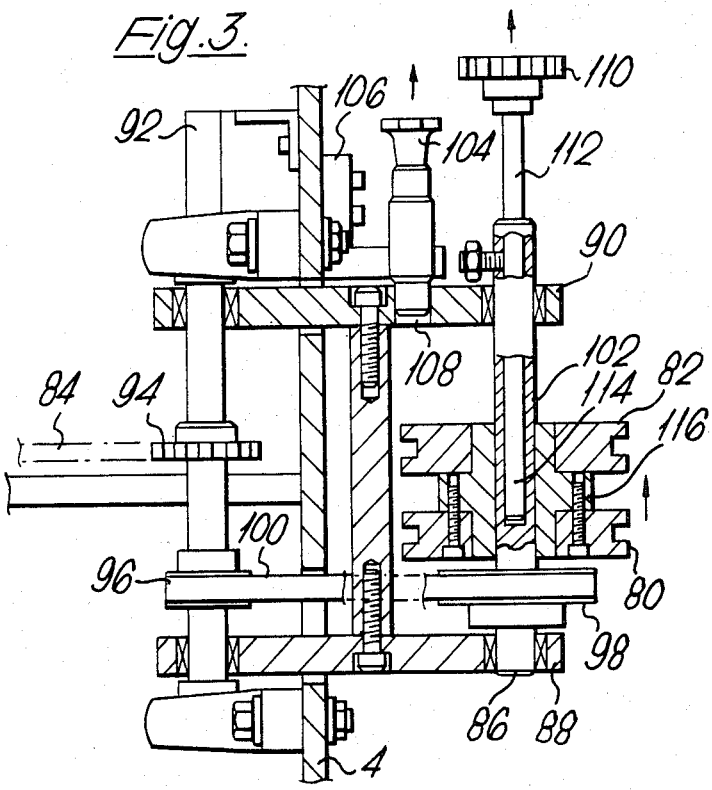
Figure 4:
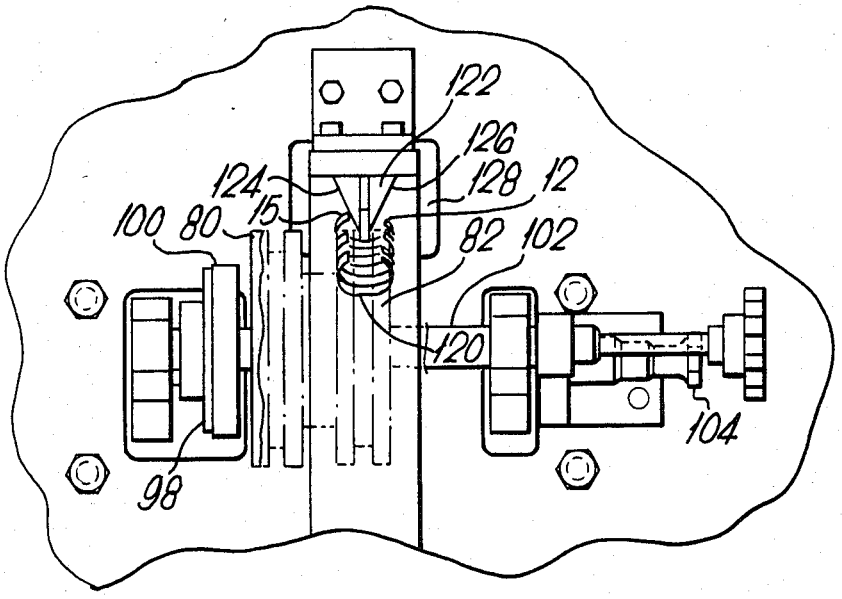
Figures 7, 7A:
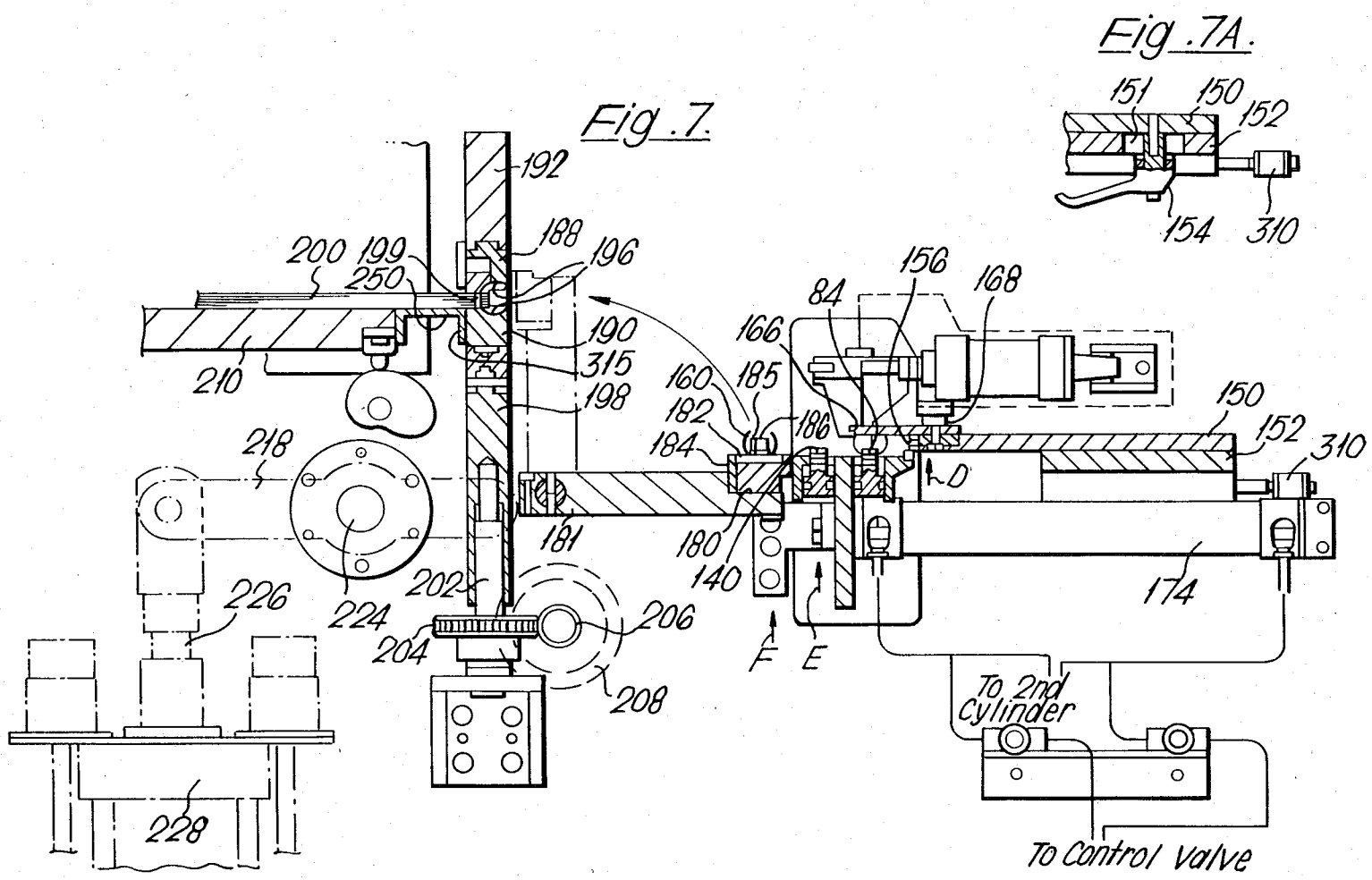
Figure 8:
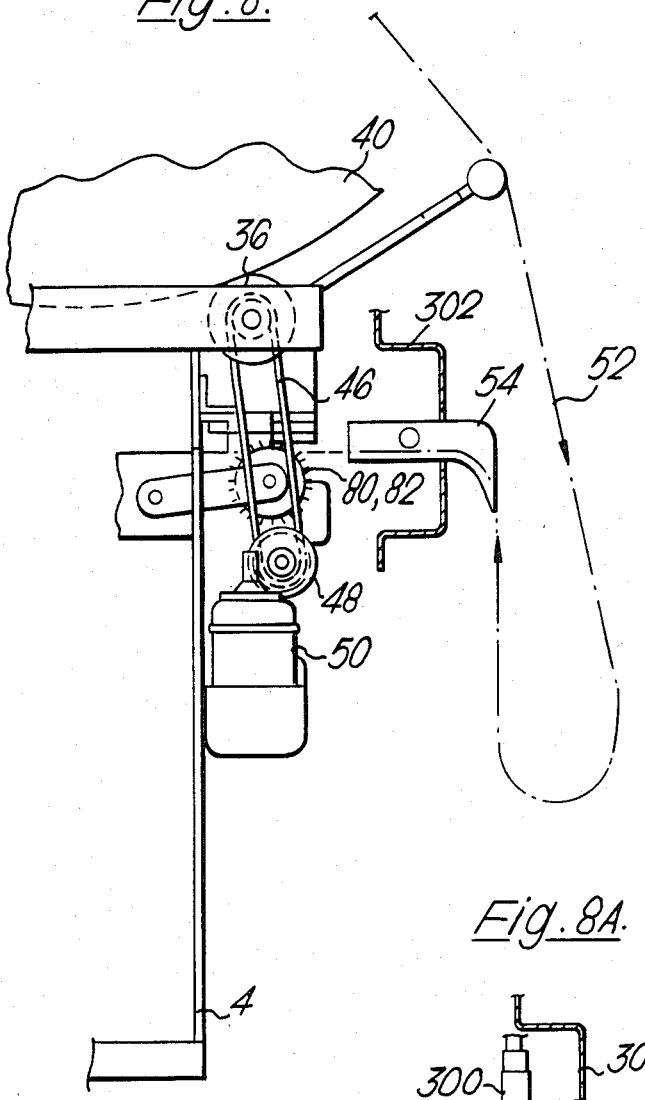
Figure 8A:
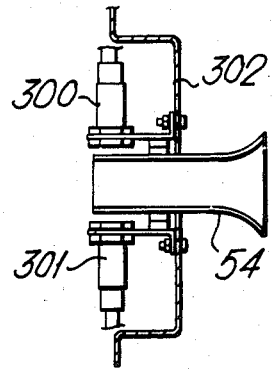
Figure 9:
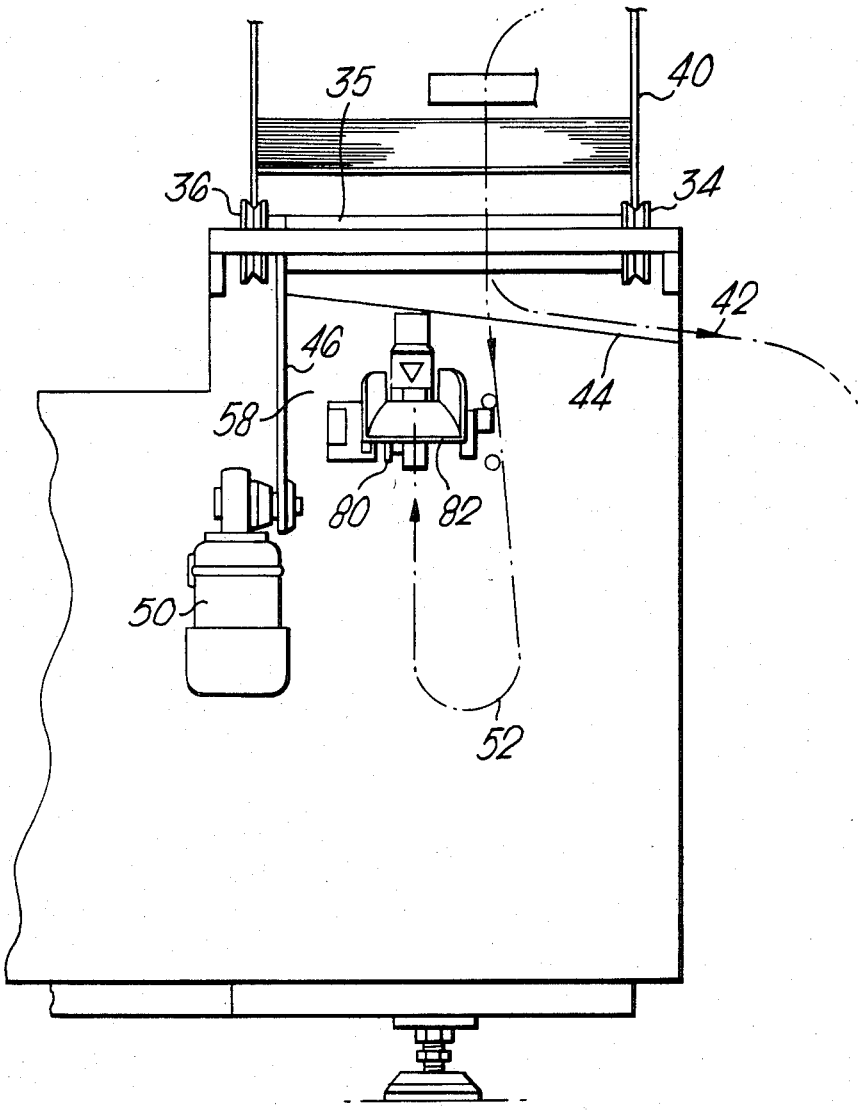
Figure 10:
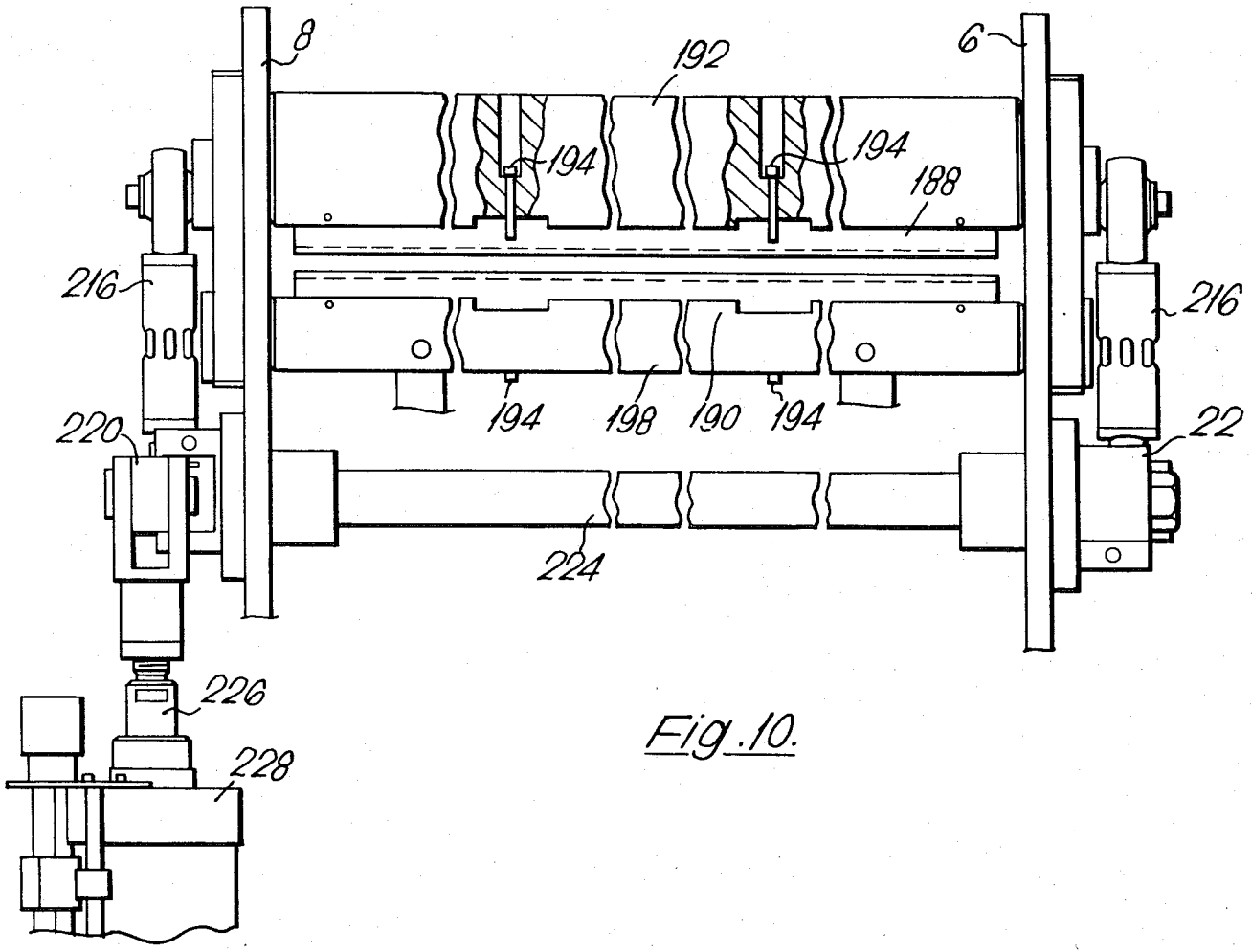
Figure 11:
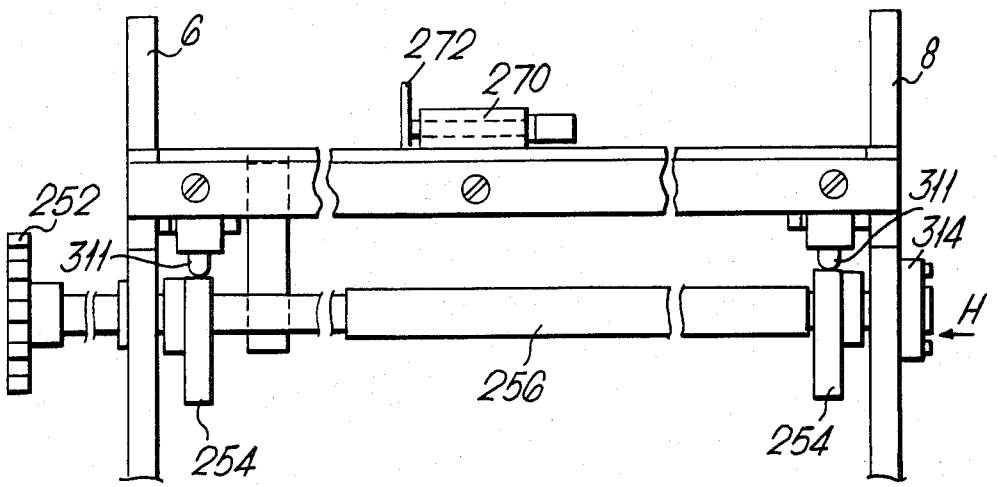
Figure 12:
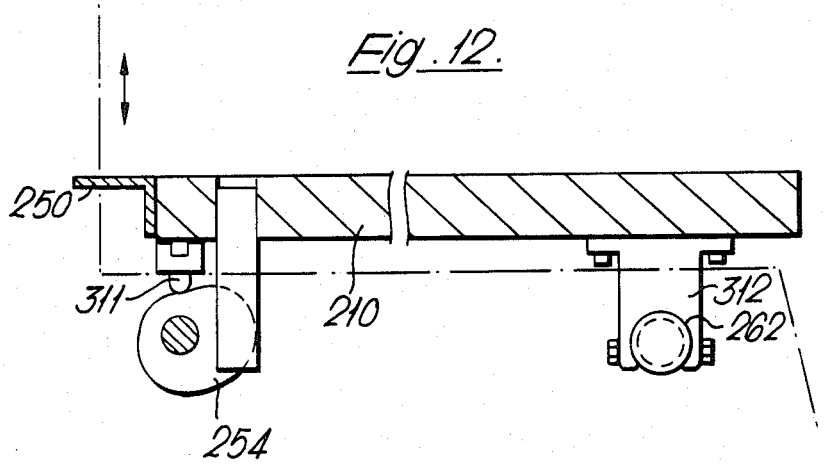
Figure 13:
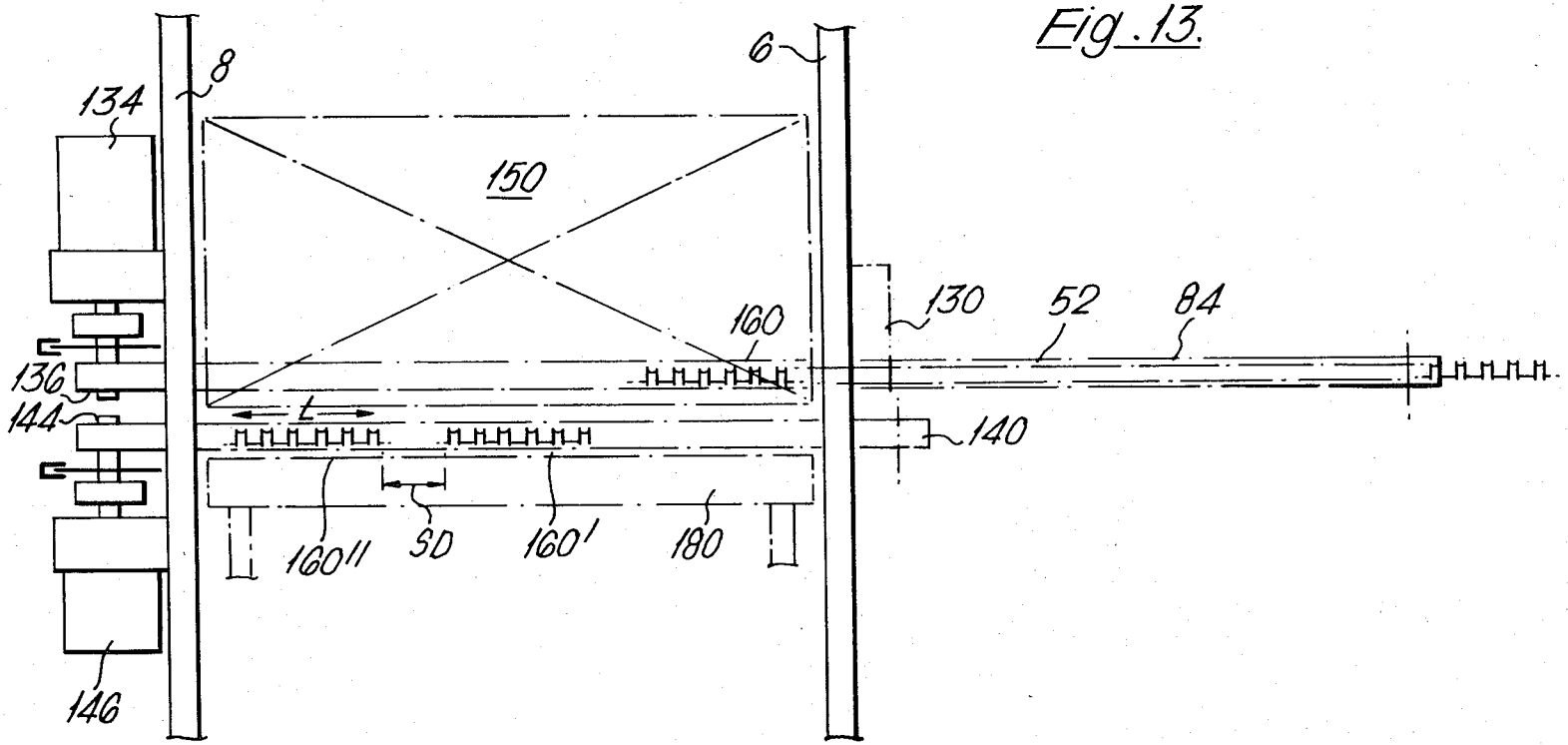
Figure 14:
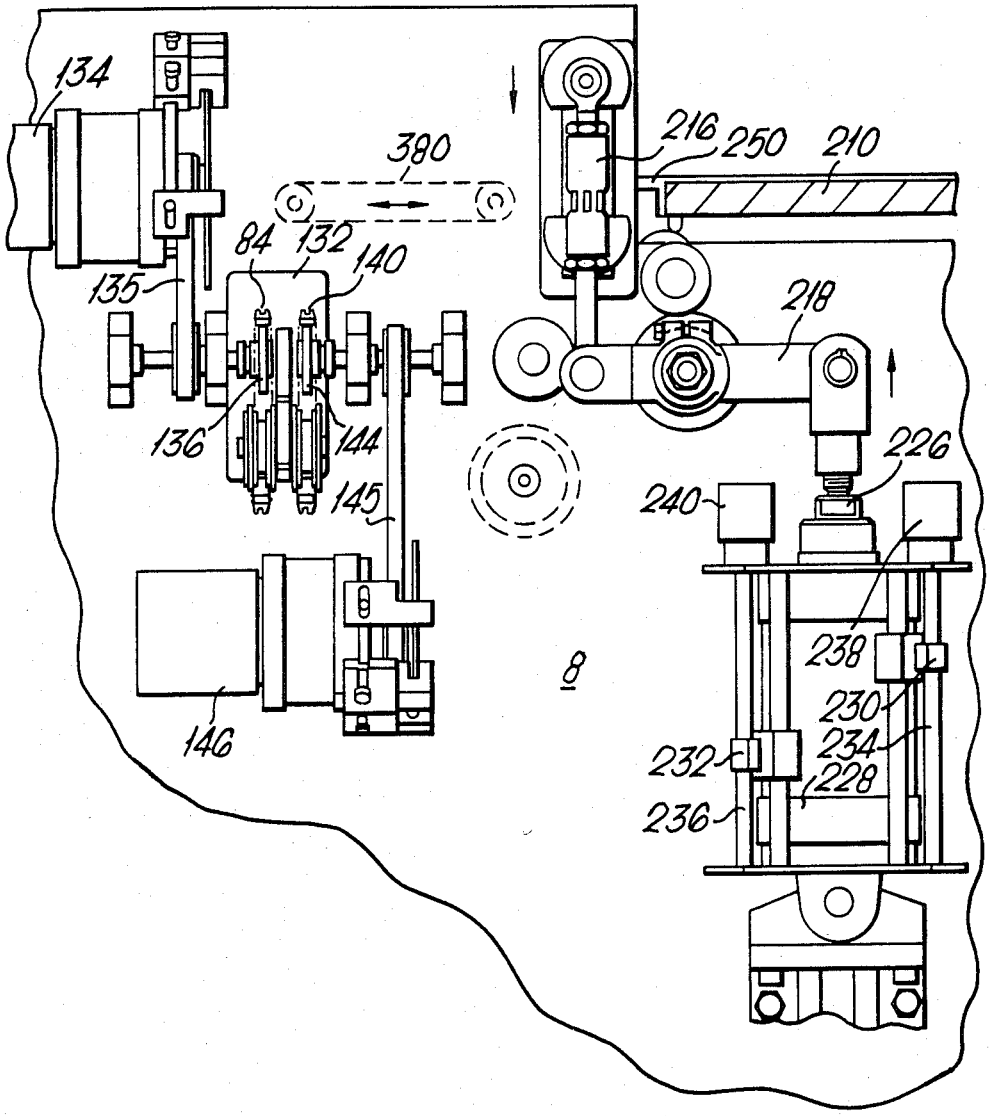
Figure 15:
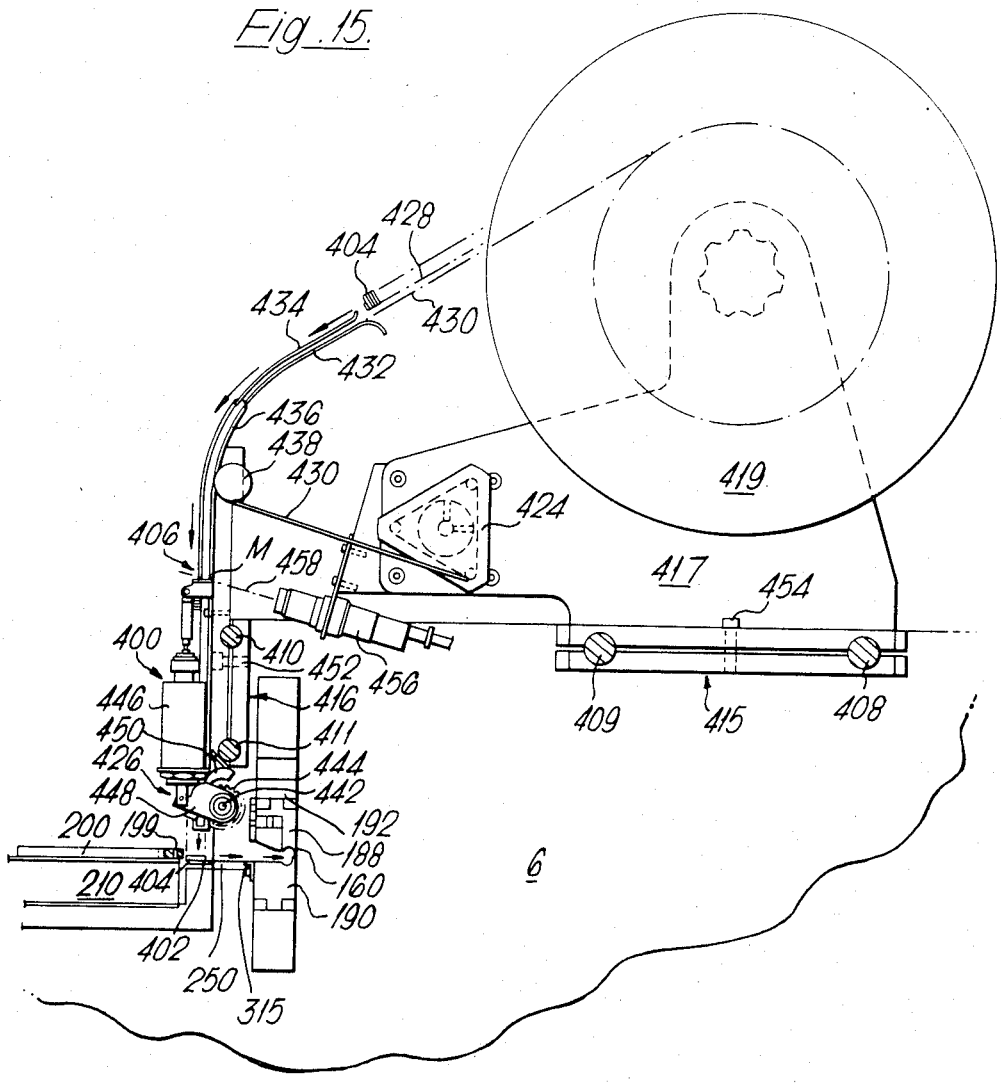
Figure 16:
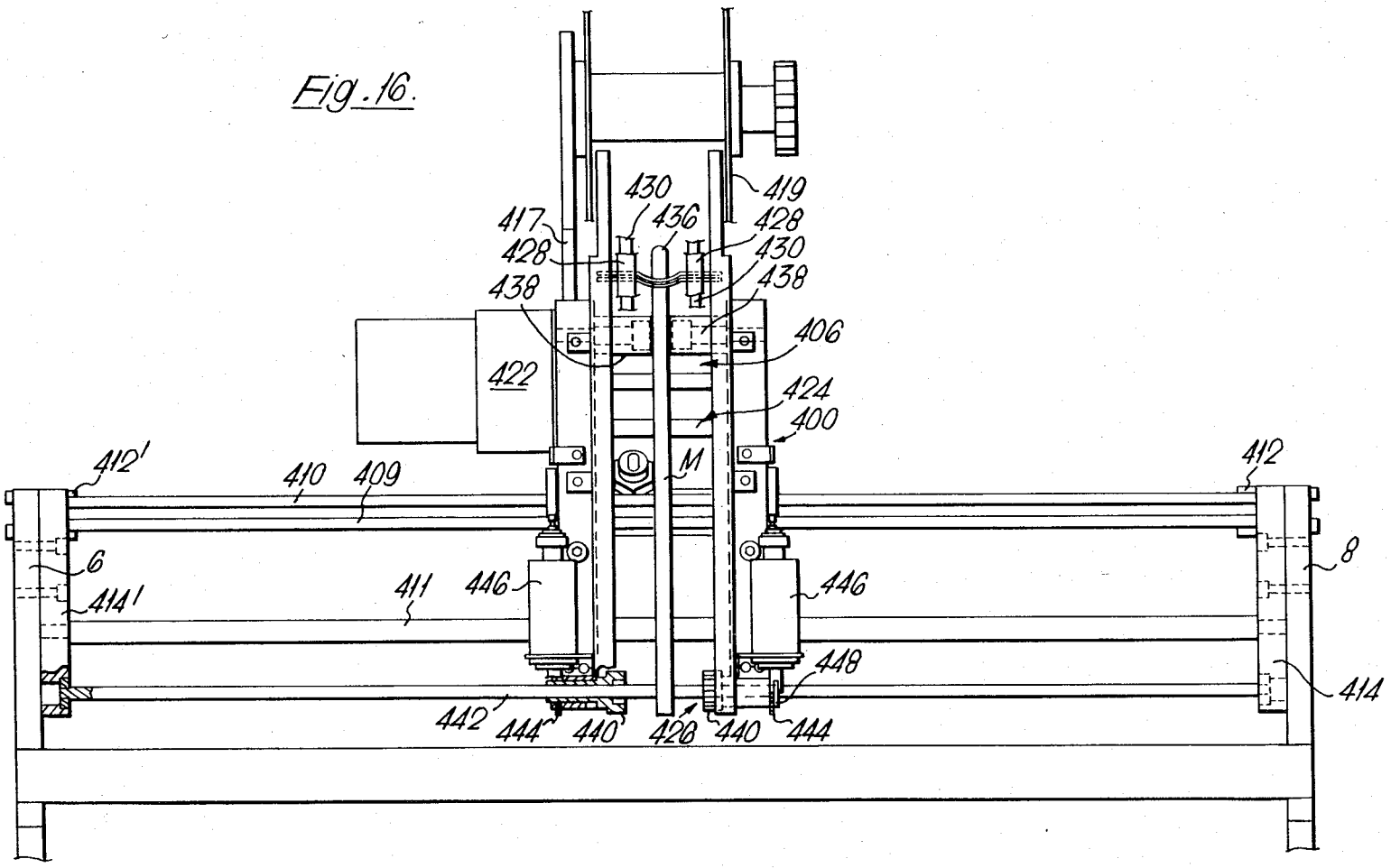

An embodiment of the invention will now be described by way of example with reference to the accompanying drawings in which:

FIG. 1 is a rear view of a binding machine according to the present invention, FIG. 2 is a front view of an input means of the machine of FIG. 1, FIG. 3 is a cross-sectional top view of the input means of FIG. 2 taken along B—B, FIG. 4 is a side view of the input means of FIG. 2 seen from A, FIG. 5 is a top view of part of a Wire 'O' binding strip for use in the machine of FIG. 1, FIG. 6 is an end view of the strip of FIG. 5, FIG. 7 is a side view of translating means, and closing means as seen from A, FIG. 7A is a side view of an adjustment device for the translating means of FIG. 7, FIG. 8 is a front view of the input means and spool take off of the machine of FIG. 1, FIG. 8A is a plan view showing proximity switches forming part of a wire feed device on the right hand side of FIG. 8, FIG. 9 is a side view from A of the input means and spool take off of FIG. 8, FIG. 10 is a front view of the closing means of the machine of FIG. 1, FIG. 11 is a rear view of a feed table of the machine of FIG. 1, FIG. 12 is a cross section taken on C—C of FIG. 11 showing table elevating arrangements, FIG. 13 is a diagrammatic plan view showing skip binding, FIG. 14 is a partial end view of the machine of FIG. 1 seen from X showing the closing means operating mechanism and conveyor drives, FIG. 15 is a side view of a hanger feed arrangement for the machine of FIG. 1, and FIG. 16 is a front elevation of the hanger feed arrangement of FIG. 15.

In the example of the machine shown in the drawings as shown in FIG. 1 which shows the rear of the machine the frame 1 supports sub frames 4, 6 and 8 which extend from front to rear. The section 20 of the machine outside frame 4 will be referred to as the input feed section; section 22 between frames 4 and 6 will be referred to as the main feed section; section 24 between frames 6 and 8 will be referred to as the binding section; and section 26 outside frame 8 on the end of the machine as seen from X will be referred to as the mechanism section.

In the feed section which is on the right of machine as seen from the front is a spool frame 30 on which are four rollers 32, 34, 36 and 38. (not shown). Rollers 36 and 34 have a rubber roller 35 of coarse textured rubber between them (See FIG. 9). The rubber roller acts to strip a paper web 42 from between layers of binding wire strip on the spool 40. The web 42 feeds over the rubber roller under the spool and is ejected down a chute 44 (see FIG. 9) to the rear of the machine.

Rollers 36 and 34 are driven by a belt 46 through a gear box 48 and by a motor 50. The motor drive is controlled via a clutch device so as to rotate the spool when receiving a signal from one of the proximity switches (300 and 301). The other switches the machine off if the wire tangles on the spool or becomes jammed in the main feed.

Before describing these arrangements it will be appreciated that the machine is arranged to handle twelve or more different sizes of binding wire, these are in one machine:

| Diameter | Pitch |
|---|---|
| 1 inch (25.4 mm) | 2 to 1 inch (25.4 mm) |
| ¾ inch (19 mm) | 2 to 1 inch (25.4 mm) |

-continued

| Diameter | Pitch |
|---|---|
| 5/8 inch (16 mm) | 2 to 1 inch (25.4 mm) |
| 9/16 inch (14 mm) | 3 to 1 inch (25.4 mm) |
| 1/2 inch (12.7 mm) | 3 to 1 inch (25.4 mm) |
| 7/16 inch (11 mm) | 3 to 1 inch (25.4 mm) |
| 3/8 inch (9.5 mm) | 3 to 1 inch (25.4 mm) |
| 5/16 inch (8 mm) | 3 to 1 inch (25.4 mm) |
| 1/4 inch (6.4 mm) | 3 to 1 inch (25.4 mm) |
| 3/16 inch (4.7 mm) | 3 to 1 inch (25.4 mm) |
| 1/4 inch (6.4 mm) | 4 to 1 inch (25.4 mm) |
| 3/16 inch (4.7 mm) | 4 to 1 inch (25.4 mm) |

The diameter has already been referred to as the "closed" diameter and the pitch is the distance between adjacent "points" 12 (see FIGS. 5 and 6). Pitch will be referred to as 2:1, 3:1, and 4:1 hereafter, omitting the linear units. Diameter will be referred to hereafter using the above fractions of an inch without the units.

When using a selected diameter Wire-O strip, this strip shown at 52 comes off the spool onto a pivotally mounted horizontal tray 54 pivoted on to the end cover 302: after passing over the tray the slack in the strip is controlled by proximity switches 300 and 301 which sense the angle deflection of the wire feed tray 54.

In the event of failure of supply of Wire-O from the spool the feed tray will deflect to its maximum limit triggering the appropriate proximity sensor resulting in the machine being switched off automatically.

After passing over the tray 54 the strip is then fed to one of two feed sprocket wheels 80, 82 one being for 2:1 and 4:1 pitch and the other for 3:1 pitch (see FIG. 3) the sprocket wheels 80 or 82 are aligned with a main feed chain shown in FIG. 3 as a broken line 84 extending from the feed section 22 through binding section 24 to mechanism section 26.

Sprocket wheels 80 and 82 are mounted with their axis 86 in brackets 88 and 90 which are pivotally mounted on shaft 92 which carries an idling main drive sprocket wheel 94 and belt drive pulley wheel 96, wheels 94 and 96 are both fixed to shaft 92 so that when the main drive conveyor chain 84 is driven wheel 96 drives a wheel 98 through belt 100 and wheel 98 fixed to shaft 102 drives wheels 80 and 82.

Brackets 88 and 90 are held in an upper position (FIG. 2) by means of a spring loaded plunger 104 mounted on bracket 106 bolted to frame 4, the plunger engaging in a hole 108 in bracket 90. Also on bracket 90 is a knob 110 on shaft 112 which within hollow shaft 102 has a pin 114 which engages with block 116 on which wheels 80 and 82 are mounted.

To shift wheel 80 into alignment with drive chain 84, plunger 104 is pulled, brackets 88 and 90 drops disengaging wheel 82 from the binding wire strip now indicated at 120, knob 110 is pulled moving wheel 80 into alignment with chain 84. The brackets are then pushed upwards engaging wheel 80 with the strip 120 and the plunger 104 is re-engaged to hold brackets up.

It will be appreciated that the drive arrangements to the wheels 80 and 82 are so arranged that the same linear feed speed is maintained between the chain 84 and wheels 80 and 82 which form a part of an input feed means.

Located above the sprocket 82 (see FIG. 4) or alternatively above sprocket 80 whichever is aligned with chain 84 is a "V" shaped guide 122 whose sloping sides 124 and 126 act to guide the blunts 15 and points 12 of the strip 120 respectively, the points being to the rear of the machine. A central guide fillet 128 at the apex of sides 124 and 126 acts to press the connecting portions 10 of the strip (see FIGS. 5 and 6) onto wheels 80, 82 and thereafter the strip onto the main drive chain 84. The guide 122 can also be formed as in our copending British patent application No. 8111808 filed 14th Apr. 1981, the contents of which are incorporated herein by reference.

The drive chain 84 forming a part of a feed device feeds strip 120 from the input feed means to a cutting means 130 not shown in detail but located in the frame 6 between sections 22 and 24. The drive chain 84 is a link chain forming a main conveyor which has a plurality of strip engaging members formed as plastics cruciform notched chain inserts which are shown in detail with the chain in our co-pending British patent application No. 8111808 filed 14th Apr. 1981. The form of the notches allows for differently pitched strip to be firmly engaged whatever the pitch.

The cutting means 130 is a knife and anvil, the knife being adjustable from top of the machine to ensure that it chops the strip on a blunt portion, adjustment being necessary when the diameter is changed.

The chain 84 extends through section 24 to a chain drive unit 132 mounted in section 26 on frame 8, the unit 132 includes a high capacity main chain drive 1.8° stepper motor 134 driving through a belt 135 a drive sprocket wheel 136 (see FIG. 14).

Running parallel to chain 84 is a skip conveyor chain 140 similarly provided with notched chain inserts whose upper conveying surface is level with the upper conveying surface of chain 84. Chain 140 extends across section 24 and between an idling sprocket wheel 142 (FIG. 1) and a drive sprocket wheel 144 (FIG. 14) driven through a belt 145 by a single 1.8° stepper motor 146 of smaller capacity than motor 134 in unit 132. Motor 146 is of a smaller capacity because chain 140 is shorter than chain 84. The skip conveyor function will be described hereafter.

Adjacent frame 6 is a stepper motor control module (not shown) which controls the predetermined indexing of the stepper motors according to a programme selected on a control panel mounted on the right hand end as seen from the rear (not shown). The cutter and the transfer of wire from chain 84 to chain 140 by a pusher mechanism forming part of a translating means are controlled entirely by the stepper motor control module.

To the rear of the main chain in section 24 and extending from side to side of the section is the pusher mechanism comprising a pusher bar 150 (see FIGS. 1 and 7) mounted adjustably on a block 152, the adjustment being relative the block and from front to rear. Adjustment between block and bar is by means of a slot 151 in block 152, lock knobs 154 and fine adjustment screws 310 one each of which is shown in FIG. 7A. The bar 150 has an element pushing surface 156 which engages against the points side of a binding element one of which is shown at 160 which has been cut from strip 120. Mounted on pusher bar 150 is a packer member 156 (changed for each wire diameter) from which extends an acrylic adjustable guide plate 166 held on by handwheels 168 so that the guide is just clear of the top of an element 160 as it sits on the chain 84. Depending on the wire diameter this guide 166 is adjusted up or down relative chain 84 by providing a packer 156 of a differing height.

The pusher bar 150 and mounting block 152 are mounted on piston mountings of a pair of rodless magnetic cylinders 174, one at each end coupled to frame 6 and frame 8. These pneumatic cylinders have 3 magnetic reed switches to enable the pusher assembly to be moved between three positions: namely, a first position D as shown in FIG. 7 with pusher assembly retracted, a second position E, with pusher assembly moved halfway forward (used when using skip binding facility) and a third position F when pusher assembly is fully forward. In the first position the pusher bar rests against binding elements 160 on the main chain. In the second position the pusher bar moves the element 160 onto the skip chain. In the third position the pusher bar moves the element 160 to a transfer bar 180.

Transfer bar 180 is pivotally mounted on a shaft 181 and movable from the horizontal position shown in FIG. 7 to an upper vertical position where it can hold an element 160 between upper and lower closing jaws 188 and 190. On the upper surface of transfer bar 180 relative its horizontal position is a plastics carrier member 182 retained onto the bar 180 by a dovetail recess in the bar and a dovetail locating plate 184. The member 182 is formed with groups of about five teeth 185 extending up from the bar 180 to about the same level as the top of the chain notched inserts and between each group a higher tooth 186 about twice the height of group teeth 185 is provided. These higher teeth 185 act as book stops in a similar way to the book stops described in our copending British patent application No. 8111828 filed 14th Apr. 1981. The member 182 however holds the elements 160 by the resilience of its material suitably high density polythene. The member 182 must be changed for each pitch and diameter used in the machine since the lateral distance between teeth 185 is relative the pitch and the book stop higher teeth 185 have a height depended on element diameter.

Pivotal control of the transfer bar 180 is by means of a pneumatic actuator (not shown) connected to shaft 182. The pusher bar mechanism and transfer bar arrangement form parts of translating means for translating the elements either singly or in plurality from the feed device conveyor to the closing means of which the closing jaws are a part.

The closing jaws 188 and 190 are separately movable but when closing they hold, then form the wire element into perforations 199 in a bundle 200 on a feed table 210, only the top jaw 188 moving. Top jaw or tool 188 is mounted in a top tool holder 192 and can be removed therefrom by unscrewing retaining screws 194 (see FIG. 10). The lower surface of jaw 188 is curved to the diameter of the element and projections 196 locating between the wire points extend from the curved surface a distance corresponding to the wire gauge. The separation of projections 196 is dependent on wire pitch, for this reason if pitch of diameter of wire is to be changed the top tool must be changed.

The bottom tool 190 is mounted in a bottom tool holder 198 to which it is retained by further retaining screws 194. This tool also has a curve forming surface to the diameter of the element and projections 196 locating between the wire points extend from the curved surface a distance corresponding to the wire gauge. The separations of projections 196 is dependent on wire pitch, for this reason if pitch or diameter of wire is to be changed, the bottom tool must also be changed.

Bottom tool 190 is adjustable for height by means of a pair of screw jacks drivable via worm wheels 204 and worms 206 from a motor 208 controlled from the control panel.

The top tool 188 is movable by means of a cylinder 228 through a pair of adjustable turnbuckles 216 attached to top tool holder 192 and to a rocker arm 218 on one side and an arm 222 on the other side (see FIG. 10). Rocker arm 218 and arm 222 are linked by a rod 224, a piston rod 226 connecting arm 218 to a piston (not shown) in cylinder 228. Cylinder 228 is pneumatically operated and has a magnetized piston (not shown). Reed switches 230 and 232 are mounted on screws 234 and 236 each driven by a respective motor 238 and 240. The stroke of the piston is adjusted between 3 positions, that is firstly piston down—upper tool fully up, secondly upper tool partially down—binding element held between jaws, and thirdly upper tool down—jaws closed. The second and third positions are those which have to be adjusted for different wire diameter and these positions are controlled by location of the reed switches 230 and 232 respectively relative to the cylinder. To change the second and third positions the motors 238 and 240 are switched on and the reed switches moved to a new predetermined position as more particularly described in patent application Ser. No. 495,171 filed May 17, 1983, now abandoned (claiming priority from British patent application No. 8214894 of 21st May 1982) incorporated herein by reference. The British application was published Jan. 11, 1984 under British Pat. No. 2122135.

In order to ensure the bundle to be bound is in the correct position for binding relative a particular diameter of binding element, the table 210 is adjustable for height. The table has a projecting rear lip 250 the rear upper edge of which must be level with the blunt portions of the wire elements. The gap between lip 250 and bottom tool 190 is taken up by a filler plate 315 (see FIG. 7).

To adjust the table a simple elevating device is shown in FIGS. 11 and 12 comprising a knob 252 accessible from the side of the machine, a pair of cams 254 mounted on shaft 256 supporting two buttons 311 fixed to the underside of the table. The front of the table has two brackets 312 with half round slots supported on two pivot bars 262 attached to frames 6 and 8. The buttons 311 are always in contact with cams 254. By turning handwheel 252 clockwise the table can be raised to required height. The handwheel can be rotated clockwise only. This is achieved by a freewheel assembly 314 mounted on cam shaft 256 and attached to frame 8. The table assembly 210, 270, 272 can be easily removed off the machine by simply lifting it up and off the pivot bars 262. This is necessary when the machine is linked to an autofeed system for pre-punched stock.

On top of the table 210 is a lay gauge 270 with an adjustable guide fence 272, the gauge being locatable in any one of a number of positions on the table. The gauge is used for aligning bundles. Also on the top of the table is a pneumatic detector 274 which detects the presence or lack of presence of a bundle on the table and with a suitable interlock circuit prevents a further element being presented to the closing jaws before the bound bundle or book is withdrawn from the table. The pneumatic detector can be replaced by an electronic or other suitable detector.

The control interlocks and sequencing arrangements are obtained by means of latching and delatching electrical relays controlled by cascaded electrical limit switches.

Skip binding is normally associated with calendar hanger insertion, as is more particularly described in our copending British patent application No. 8126674 filed 3rd Sept. 1981, the contents of which are included herewith by reference. In the present application the hanger feed is simplified. In the present machine a hanger feed attachment 400 is removably located at the binding station 24, in front of closing tools 188, 190 and above the lip 250 of table 210, with enough gap in between to allow the maximum allowable bulk or bundles to pass through to the rear of the machine. Incorporated into lip 250 is a magnet strip 402 situated conveniently to locate a hanger 404 correctly when it is dropped from a hanger magazine 406. The feed attachment 400 is fastened between frames 6 and 8 by means of four rods 408, 409, 410 and 411 mounted to the frames 6 and 8 at each end by suitable blocks 412, 412', 414 and 414'. The attachment 400 comprises a mounting plate 417 to which is pivotally mounted a motor 422 mounted to plate 417 driving a spider wheel 424. The attachment also comprises the magazine 406 and a magazine feed device 426. The hangers 404 are retained on the drum 419 by means of two strips of plastics material 428 and two opposed strips of adhesive tape 430. The hangers are fed from the drive to curved side guides 432 and 434 to a central guide 436. After engaging with the central guide the tapes 430 are led over pulleys 438 to spider wheel 424, thus stripping the tapes off the hangers. The plastics strips are discharged freely to the rear of the machine. The hangers then drop under gravity down straight portions of guides 432, 434 and 436 to two cog wheels 440 mounted on shaft 442. These cog wheels are made from hard nylon material in order to avoid damage to hangers as they locate and pass along peripheral grooves formed between the teeth of the wheels. At the other end of two cog wheels are located ratchet index wheels 444, the number of teeth on the ratchet index wheels being the same as on the cog wheels, but the profile of the teeth being of triangular shape, allowing a pivoted spring loaded index pawl 450 to index a tooth one at a time. The spring loaded fixed pawl anchored at the rear stops the movement of the ratchet wheel in the opposite direction. The ratchet index wheels turn in unison with the cog wheels which rotate together on the square shaped shaft 442 which passes through a square hole in an insert in the cog wheel. The length of this bar stretches the full length of the binding station. Indexing is achieved by activating a pair of electromagnetic solenoids 446 mounted on either side of channels of the hanger magazine assembly. An electric signal to activate the solenoids is sent through the machine electric controls at an appropriate time. At the bottom end of each solenoid plunger is attached an arm 448 to which a spring loaded index pawl is pivoted.

This hanger feed attachment is capable of feeding 70 mm to 610 mm long hangers but is easily adjustable between at least 60 mm and 610 mm. This is achieved by slackening two lock screws 452 on the hanger magazine sections and sliding the side guides and centre guide along the two round rods 410 and 411 to the position required and locating them symmetrically about the centre guide rail and to suit the length of the hanger to be used. Similarly repositioning of the hanger reel mounting is achieved by slackening a single lock screw 454 and sliding the mounting along the two round rods 408, 409 situated at the rear of the hanger magazine assembly.

Auto-unwinding of the hanger reel is performed by motor 422 winding the adhesive tape 430 when it receives an electric signal from an opto-reflective sensor 456 situated conveniently with its beam 458 directed to sense when the hanger magazine is empty of hangers above a point M in the magazine.

Control details of the present machine are more particularly described in copending U.S. patent application Ser. No. 354,760 filed 4th Mar. 1982 in the name of Leonard W. N. Jones and Ross Doughty, also in our copending U.S. patent application Ser. No. 495,179 filed May 17, 1983, now abandoned and in the name of the same present Inventor. The subject matter of these two patent applications is incorporated herein by reference.

I claim:

1. A machine for binding a packet of perforated sheets into book form, said packet being so bound by a wire binding element closed through the aligned perforations in said packet, said machine comprising input feed means adapted to supply a continuous length binding element from a source thereof, cutting means adapted to cut said continuous length binding element into discrete predetermined lengths, a feed conveyor indexed with said input feed means to deliver said continuous length element from said input feed means to said cutting means, closing means at a closing station arranged to be fed with said discrete predetermined length elements, stack means for supporting a stack of perforated sheets at said closing station, translating means for moving said discrete length elements from said feed conveyor to said closing means, and a spacing conveyor running parallel to said feed conveyor, said spacing conveyor being laterally spaced from and interposed between said feed conveyor and said closing means at said closing station, said discrete predetermined length elements being translated laterally from said feed conveyor onto said spacing conveyor, after being cut, and thereafter said discrete length elements being translated laterally from said spacing conveyor to said closing means.

2. A machine according to claim 1, said machine comprising control means for stopping said feed and spacing conveyors after cutting each of first and second discrete length elements from said continuous length element, said feed and spacing conveyors being arranged to be started and stopped so that said spacing conveyor travels further than said feed conveyor by a predetermined distance after each discrete element is cut to length, pusher means forming part of said translating means, said pusher means pushing said first discrete element from said feed conveyor to said spacing conveyor prior to cutting said second discrete element to length, and said pusher means also pushing said second discrete length element from said feed conveyor to said spacing conveyor, thereby establishing a gap between said first and second elements on said spacing conveyor.

3. A machine according to claim 2, said pusher means also being adapted to push said two discrete length elements from said spacing conveyor toward said closing means.

4. A machine according to claim 3, said translating means comprising a part adapted to swing said first and second elements to a position between jaws of said closing means, said pusher means being arranged to push said two elements into cooperative engagement with said part.

5. A machine according to claim 4, said machine further comprising a magazine adapted to hold a plurality of hangers, each hanger comprising a pair of coaxial arm portions and an intermediate hook engaging portion, said hangers being feedable from said magazine to a binding position between jaws of said closing means, and adjustment means for said magazine to permit proper positioning of each hanger at the binding width center of said packet.

6. A machine according to claim 5, said hanger being fed from a direction, relative to the jaws of said closing means, that is the opposite to that direction from which said discrete length elements are moved.

7. A machine according to claim 5, said hangers being fed to said hanger feed magazine on an adhesive strip, said machine further comprising indexing means for feeding said hangers from said magazine.

8. A machine according to claim 5, said packet being used to push a hanger into binding position between jaws of said closing means.

* * * * *

UNITED STATES PATENT AND TRADEMARK OFFICE

CERTIFICATE OF CORRECTION

PATENT NO. : 4,525,117

DATED : June 25, 1985

INVENTOR(S) : Leonard William Norton Jones

It is certified that error appears in the above-identified patent and that said Letters Patent is hereby corrected as shown below:

Column 8, line 8, "495,179" should be -- 495,172 --

Signed and Sealed this

*Twenty-second* Day of *October 1985*

[SEAL]

*Attest:*

DONALD J. QUIGG

*Attesting Officer*

*Commissioner of Patents and Trademarks—Designate*